US005853042A

United States Patent [19]

Hunter

[11] Patent Number: 5,853,042

[45] Date of Patent: Dec. 29, 1998

[54] DRAG MOLD RELEASE MECHANISM

[75] Inventor: William A. Hunter, Naples, Fla.

[73] Assignee: Hunter Automated Machinery Corporation, Schaumburg, Ill.

[21] Appl. No.: 30,982

[22] Filed: Feb. 26, 1998

[51] Int. Cl.[6] ..... B22C 7/04; B22C 9/02; B22C 21/00

[52] U.S. Cl. ..... 164/456; 164/29; 164/154.2; 164/182; 164/239; 164/243; 164/384

[58] Field of Search ..... 164/456, 29, 40, 164/44, 154.2, 180, 182, 213, 214, 227, 239, 243, 374, 384

[56] References Cited

U.S. PATENT DOCUMENTS

| | | | |
|---|---|---|---|
| 3,406,738 | 10/1968 | Hunter | 164/182 |
| 3,506,058 | 4/1970 | Hunter | 164/37 |
| 3,520,348 | 7/1970 | Hunter | 164/193 |
| 3,648,759 | 3/1972 | Lund et al. | 164/182 |
| 3,878,881 | 4/1975 | Lund et al. | 164/243 X |
| 4,593,740 | 6/1986 | Buhler | 164/44 X |
| 5,022,512 | 6/1991 | Hunter | 198/718 |

FOREIGN PATENT DOCUMENTS

| | | | |
|---|---|---|---|
| 58-125339 | 7/1983 | Japan | 164/213 |
| 58-154435 | 9/1983 | Japan | 164/44 |
| 60-15044 | 1/1985 | Japan | 164/180 |

*Primary Examiner*—J. Reed Batten, Jr.
*Attorney, Agent, or Firm*—Leydig, Voit & Mayer, Ltd.

[57] ABSTRACT

The drag flask has at least two opposed sides which include recesses proximate the matchplate. Manifolds are provided in the recesses to communicate compressed air from a source of compressed air to air inlets provided in the manifold. The manifolds are separated from the recesses using an elastomeric seal which is contoured to direct the compressed air between an air passage disposed between the drag mold and the matchplate. When incorporated into a sand mold forming machine, sensors are positioned on the sand mold forming machine to detect when the drag flask has reached a releasing position to thereby cause the source of compressed air to inject air into the manifold and air passage for release of the drag mold from the drag flask.

20 Claims, 6 Drawing Sheets

DRAG MOLD RELEASE MECHANISM

FIELD OF THE INVENTION

The present invention generally relates to metal casting machines utilizing green sand molds, and more particularly relates to release mechanisms for releasing sand molds from a flask once they are formed.

Background Of The Invention

Metal objects and parts are often manufactured using a green sand mold having an upper and lower portion referred to as a cope mold and a drag mold, respectively. The cope and drag molds themselves are manufactured of sand which is compressed within flasks around a matchplate having patterns protruding into the flasks. The sand is compressed around the matchplate to leave a cavity corresponding to the shape of the desired metal part or casting. The cope mold and drag mold then have complementary cavities formed therein such that when the cope mold and drag mold are combined into a single mold, the cavities combine to form the overall cavity having the shape of the desired casting.

The cavity can then be filled with molten metal and allowed to cool to result in a metal casting. Prior art systems for this purpose are disclosed in Hunter U.S. Pat. No. 3,406,738 for "Automatic Matchplate Molding Machine"; Hunter U.S. Pat. No. 3,506,058 for "Method Of Matchplate Molding"; Hunter U.S. Pat. No. 3,520,348 for "Fill Carriages For Automatic Matchplate Molding Machines"; Hunter U.S. Pat. No. 4,156,450 for "Foundry Machine And Method And Foundry Mold Made Thereby"; and Hunter U.S. Pat. No. 5,022,512 for "Automatic Matchplate Molding System".

As disclosed in any of the aforementioned patents, the drag mold is formed using a drag flask which includes four sides forming a rectangular enclosure having an open top and bottom. A matchplate is attached to the drag flask through the open top to create a box-like structure adapted to receive green sand therein. As used herein, the term "green sand" is used to define a mixture of sand and a binding agent which when compressed has an enhanced ability to retain a given shape.

As disclosed in the aforementioned patents, the sand can be delivered to the drag flask using either a gravity feed system, or an air injection system. Using the gravity feed system, a hopper is disposed above the inverted drag flask to allow the sand to fall therein. Using the air injection system, the drag flask can remain in an upright position with the matchplate on top and sand is injected using compressed air from below. A plate or squeeze head is then compressed into the drag flask to compress the green sand between the squeeze head and the matchplate such that the protrusions of the matchplate form cavities within the green sand mold.

Once the drag mold is compressed into the drag flask, a mechanism needs to be provided to release the compressed drag mold from the flask without disrupting the compressed mold or the cavity formed therein. In prior art devices, the drag flask is typically coated with a release agent which is a chemical compound which lines the drag flask and matchplate to form a barrier between the sand and the flask to thereby discourage adhesion between the two. In addition, a vibrating mechanism is commonly employed to generate a mechanical force which vibrates the drag flask to thereby cause the sand mold to fall from the drag flask.

In other prior art devices, a mechanical mechanism is combined with the drag flask such that when the sand is compressed within the flask, the interior walls of the flask are biased inwardly to thereby grip the compressed sand into the flask. When it is desired to release the sand mold from the flask, the interior walls are retracted to thereby free the sand mold to allow gravity to pull the sand mold from the flask. Such a device is disclosed in U.S. Pat. No. 5,022,512, assigned to the present assignee.

However, with any of the prior art devices described above, difficulty can be encountered in separating the drag mold from the matchplate provided at the top of the drag flask. This is especially the case today in that improved and higher quality sand is typically being employed which has a higher hardness level tending to adhere to the matchplate to a greater degree.

SUMMARY OF THE INVENTION

It is therefore a primary aim of the present invention to provide a release mechanism for a drag mold forming apparatus which improves the ease and reliability with which the drag mold can be released from the drag flask after being formed.

It is an objective of the present invention to provide a release mechanism for a drag flask which can be used without the need for chemical linings within the drag flask, vibrating mechanisms, or spring biased interior liners.

It is still another objective of the present invention to provide a method for releasing a drag mold from a drag flask and matchplate which results in a more predictably formed drag mold.

In accordance with these aims and objectives, it is a feature of the preferred embodiment of the present invention to provide a sand mold forming apparatus of the type including a drag flask for forming a drag mold of compressed green sand having an internal cavity corresponding to a portion of a desired casting, and a matchplate attached to the drag flask and having patterns protruding therefrom for forming the internal cavity, as well as an improved mechanism for releasing the drag mold from the drag flask and matchplate. The improved release mechanism includes a plurality of air inlets within the drag flask adapted to communicate compressed air between the drag mold and the matchplate and a means for communicating compressed air from a source of compressed air to the plurality of air inlets.

It is another feature of the present invention to provide an improved sand mold forming apparatus release mechanism as described above wherein the drag flask includes four sides forming a rectangular enclosure with an open top and bottom, the matchplate is attached to the rectangular enclosure with the patterns protruding through an open top of the enclosure, and the plurality of air inlets are provided in the drag flask sides proximate the open top.

It is yet another feature of the present invention to provide an improved sand mold forming apparatus release mechanism as described above wherein the plurality of air inlets are provided in at least two opposed sides of the drag flask, wherein the two opposed sides include longitudinal recesses therein. The release mechanism further includes manifolds disposed within the recesses to communicate compressed air from a centrally disposed inlet to a plurality of outlets provided along the manifold.

It is still another feature of the present invention to provide an improved sand mold forming apparatus release mechanism as described above wherein the manifolds are dimensioned to be slightly below the matchplate to define an air passage therebetween and wherein the release mechanism further includes an elastomeric seal provided between the manifold and a side of the recess. The elastomeric seal is contoured to direct the compressed air between the matchplate and the drag mold through the air passage.

It is still another feature of the present invention to provide the improved sand mold forming apparatus release mechanism as described above wherein the drag flask is adapted for vertical movement during compression of the green sand mold and wherein the mechanism further includes a sensor to detect when the drag flask has reached an end of the vertical movement. The sensor is adapted to transmit a signal to the source of compressed air to direct compressed air to flow through a conduit attached to the drag flask to release the sand mold. The conduit includes an outlet connected to the manifold inlet and an inlet adapted to mate with the source of compressed air. The outlet for the source of compressed air includes an elastomeric seat adapted to receive the conduit when the drag flask has reached an end of the vertical movement.

It is still another feature of the present invention to provide a sand mold forming apparatus including a drag flask, matchplate, frame, and means for injecting pressurized air into the drag flask. The drag flask includes four sides defining a rectangular enclosure having an open top and bottom. The matchplate is attached to the drag flask with patterns protruding from the matchplate and into the rectangular enclosure through the open top. The drag flask is adapted to be filled with sand to be compressed around the matchplate patterns from a compressive force directed through the open bottom of the drag flask. The means for injecting the pressurized air into the drag flask releases the compressed green sand drag molds from the drag flask and matchplate and onto the frame.

It is still another feature of the present invention to provide a method for releasing a drag mold from a drag flask and matchplate attached thereto including the steps of providing a plurality of air inlets in the drag flask between the drag flask and the matchplate, and injecting compressed air through the air inlets to force compressed air between the drag mold and the matchplate to release the sand mold from the matchplate to allow gravity to pull the sand mold from the drag flask.

These and other aims, objectives, and advantages of the invention, will become more apparent from the following detailed detailed description when taken in conjunction with the accompanying drawings.

DETAILED DESCRIPTION OF THE PREFERRED EMBODIMENT

Figure 1:
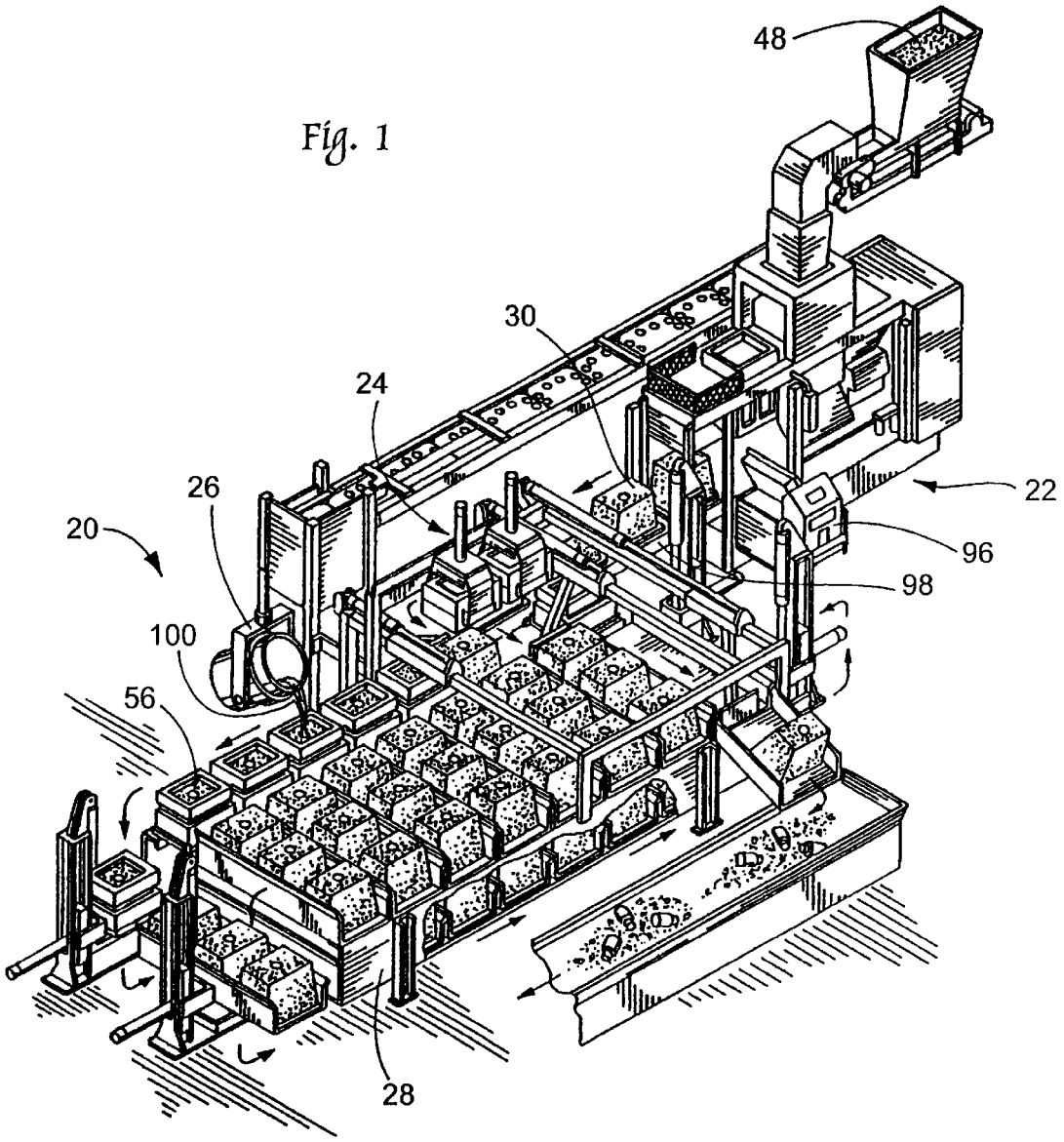
FIG. 1 is a perspective view of an entire green sand mold forming and cooling line employing the preferred embodiment of the present invention.

Referring now to the drawings, the preferred embodiment of the present invention is generally depicted as part of sand mold forming and pouring system 20. As depicted therein, sand mold forming and pouring system 20 is comprised of a series of machines which work in conjunction to provide an automatic process by which sand molds are formed. For example, U.S. Pat. No. 3,406,738 discloses a system wherein the process begins with a supply of sand, and results in intricately formed molds having an internal cavity corresponding to the shape of a desired metal casting. The disclosure of U.S. Pat. No. 3,406,738 is expressly incorporated by reference herein.

As shown in FIG. 1, sand mold forming and pouring system 20 includes mold forming station 22, weight and jacket installation station 24, pouring station 26, and cooling station 28. While the overall sand mold forming and pouring system 20 is depicted in FIG. 1, it is to be understood that the primary scope of the present invention is directed to mold forming station 22. It is also to be understood that while the system 20 depicted in FIG. 1 shows linear and double-deck pouring and cooling stations 26 and 28 respectively, the present invention can be incorporated into various other types of sand mold and casting machinery including those using a carousel type cooling station such as that disclosed in U.S. Pat. No. 5,022,512, or linear systems having fewer pouring and cooling lines.

Figure 2:
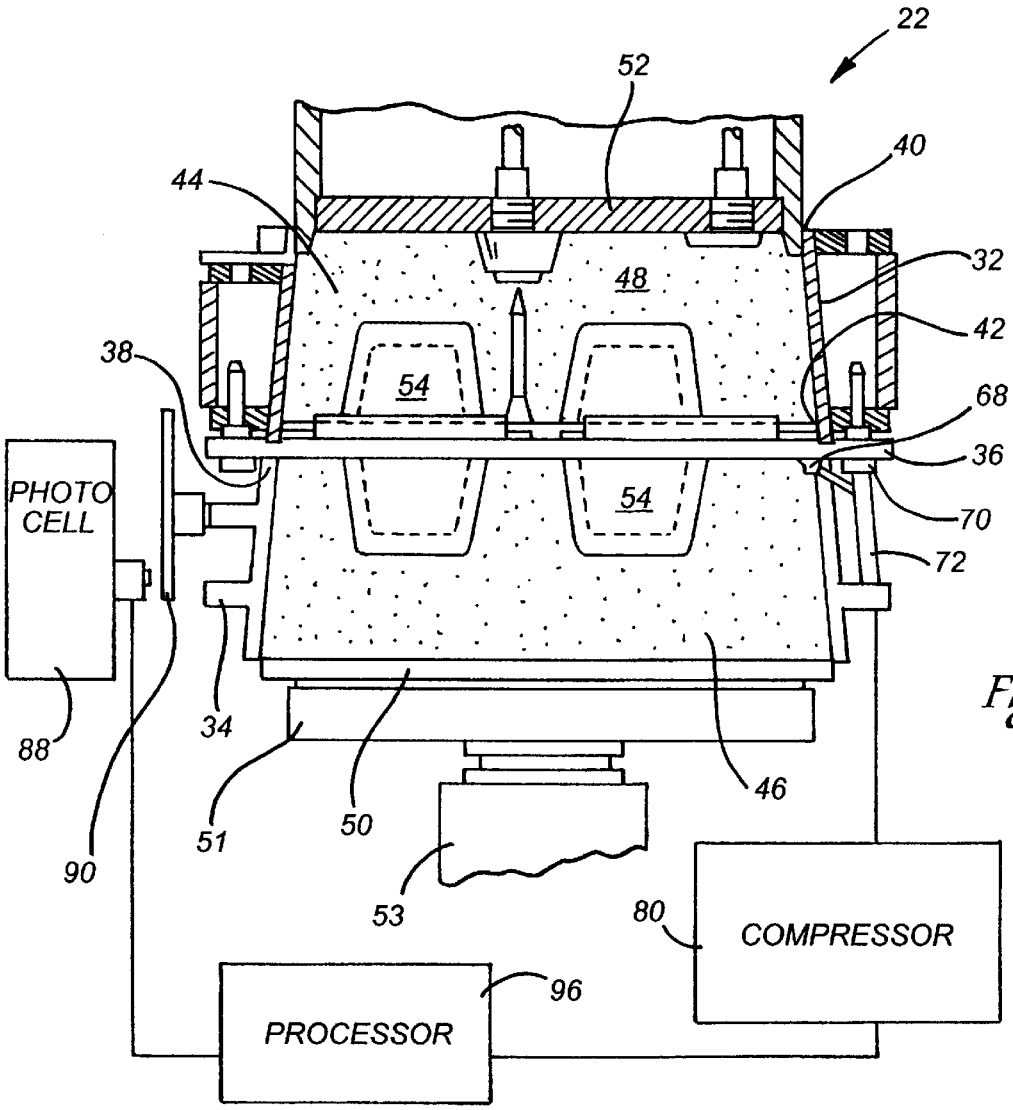
FIG. 2 is a schematic view of the sand mold forming machine in a pre-compressed state.
Figure 3:
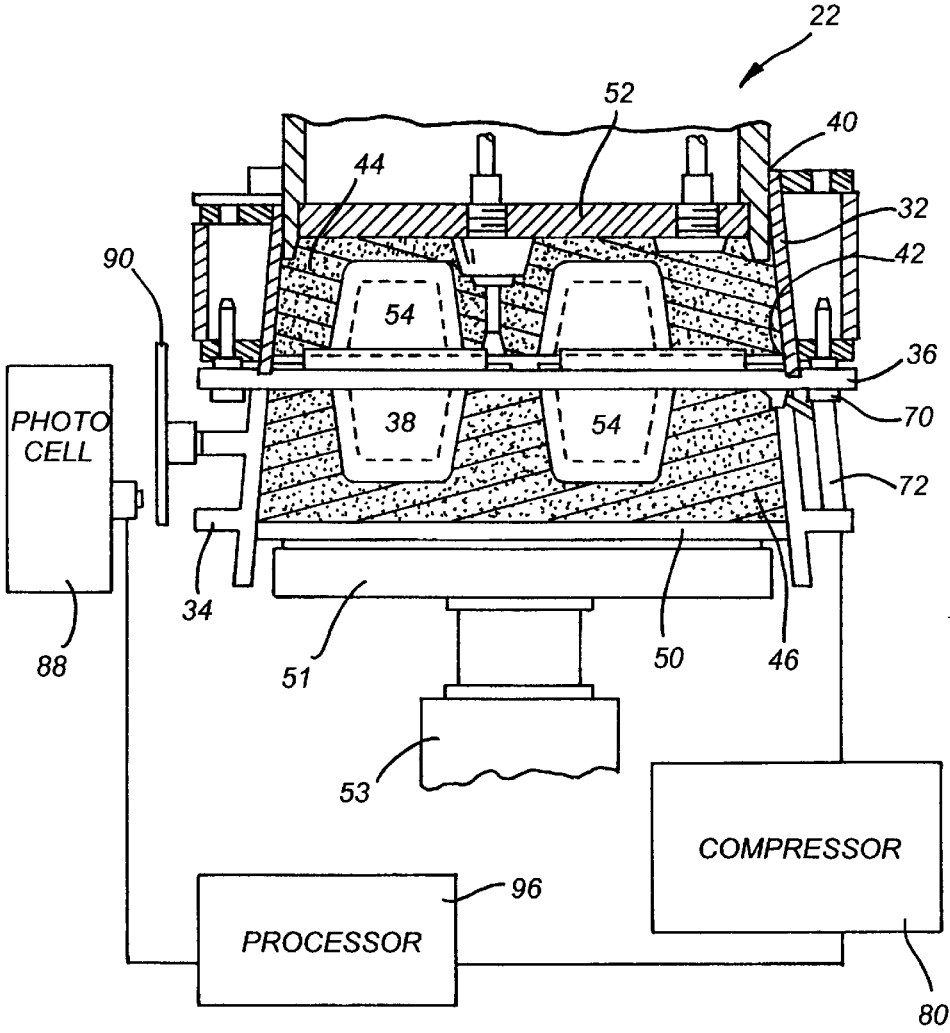
FIG. 3 is a schematic view of the sand mold forming station in the compressed state.
Figure 4:
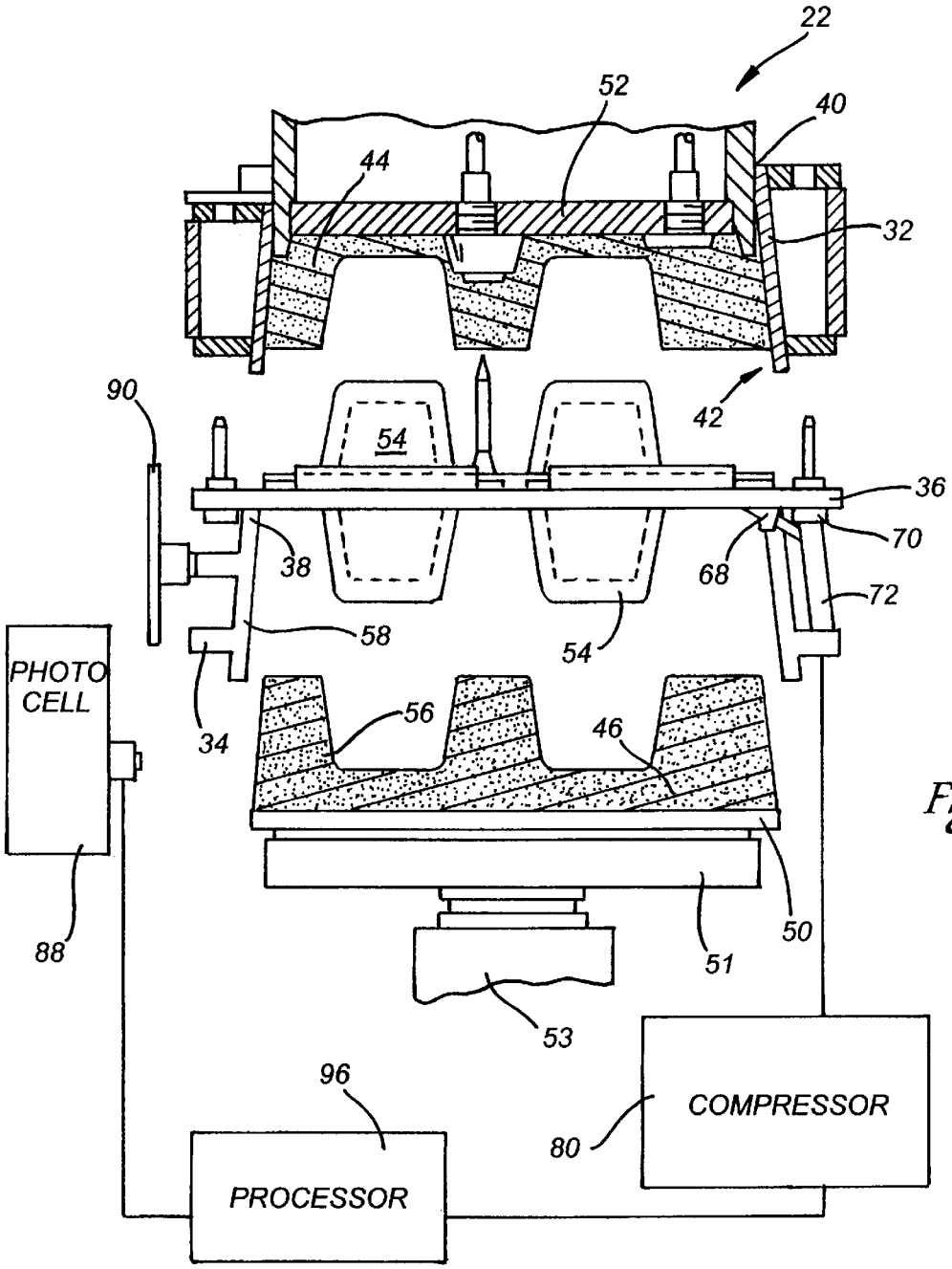
FIG. 4 is a schematic view of the sand mold forming machine in the released state.

Turning now to FIGS. 2–4, mold forming station 22 is shown schematically in three different stages of mold formation. FIG. 2 shows mold forming station 22 prior to compressing sand mold 30 (FIG. 1). As will be readily apparent to those of ordinary skill in the art, sand mold forming station 22 includes cope flask 32 and drag flask 34 which form the outer, rectangular chambers in which sand mold 30 can be formed. It can also be seen that mold forming station 22 includes matchplate 36 which is fastened to drag flask 34 at upper end 38 thereof. Conversely, cope flask 32, which is used to form the upper, or cope mold portion of sand mold 30, includes open top 40 as well as open bottom 42.

However, in order to form cope mold 44 and drag mold 46, cope flask 32 is positioned over matchplate 36, as shown in FIG. 2 and is filled with sand 48. This is after drag flask 34 has been gravity filled with sand 48, inverted, compressed, and transferred to lower platform 50. It can also be seen that an upper squeeze head 52 is positioned to move into open top 40 of cope flask 32 as platen 51 moves upwardly.

Once cope flask 32 and drag flask 34 are filled with sand 48 and positioned such as that shown in FIG. 2, mold forming station 22 can begin the step of compressing sand 48 within the flasks to form cope molds 44 and drag molds 46. This step is depicted best in FIG. 3 which shows bottom board 50 and platen 51 having been moved upwardly which in turn causes sand 48 within drag flask 34 to compress against the bottom of matchplate 36. Since matchplate 36 includes a plurality of patterns 54 protruding downwardly therefrom, corresponding cavities 56 (FIG. 4) are formed within drag mold 46. The upward force of platen 51 also causes matchplate 36 and drag flask 34 to move upwardly (FIG. 3) against cope flask 32 and squeeze head 52 to cause sand 48 to be compressed into cope flask 32 to form cope mold 44. Matchplate 36 includes patterns 54 protruding upwardly therefrom to form complementary cavities 56 within cope mold 44. In the preferred embodiment of the present invention, upper squeeze head 52 is stationary and platform 50 and platen 51 are hydraulically powered to move upwardly at the direction of ram 53, however, alternative embodiments could employ different power sources or apply the compressive force from the top as opposed to the bottom.

Once the compression step depicted in FIG. 3 is completed, the true inventiveness of the present invention can be best appreciated as shown in FIG. 4. With prior art devices, once drag mold 46 is compressed into drag flask 34, gravity is normally used to remove drag mold 46 from drag flask 34 simply by raising drag flask 34 away from platen 51, or similarly lowering platen 51 away from drag flask 34. The separation of drag mold 46 from platen 51 causes gravity to pull drag mold 46 downward to remain on platform 50 as drag flask 34 is moved upward. In other prior art devices, a chemical compound is sprayed onto the inner surface 58 of drag flask 34 and matchplate 36 to prevent or deter adhesion of sand 48 thereto. Similarly, a vibrating mechanism can be employed to vibrate drag flasks 34 to force drag mold 46 out of drag flasks 34.

However, with today's versions of sand mold forming operations, improved qualities of sand having increased hardness levels are being used to form cope mold 44 and drag mold 46. This increased hardness level has caused the drag mold 46 to adhere to matchplate 36 and drag flask 34 with increased vigor. Conventional gravity powered, chemically lubricated, or mechanically vibrated systems therefore have not resulted in acceptably formed drag molds 46 in that the drag mold 46 will remain within drag flask 34 entirely, or portions of drag mold 46 will fall from drag flask 34, while other portions of the drag mold will remain within drag flask 34. In either event, an unacceptable and unusable drag mold 46 is formed. However, with the present invention, a drag mold 46 can be easily and predictably removed from drag flask 34 completely intact.

Figure 6:
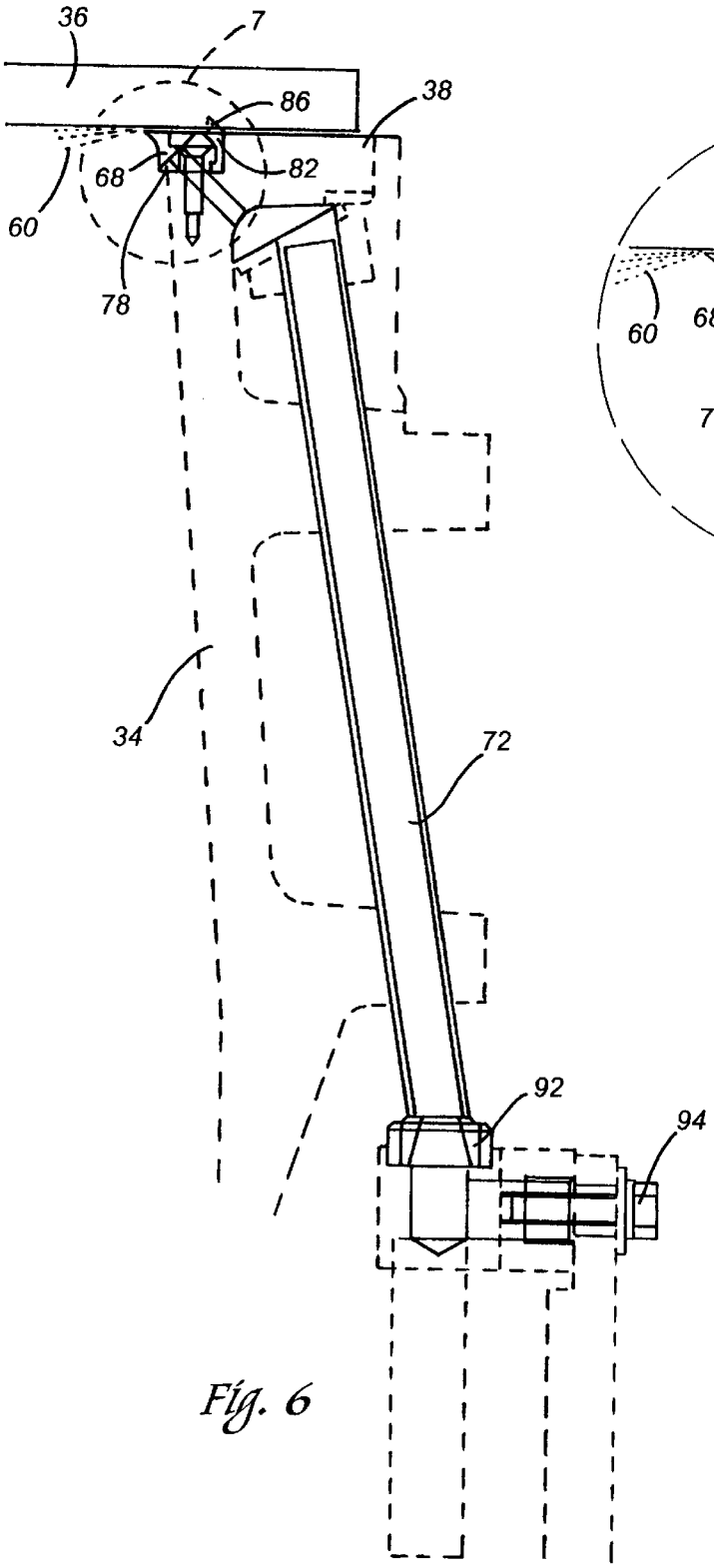
FIG. 6 is a sectional view taken along line 6—6 of FIG. 5.
Figure 7:
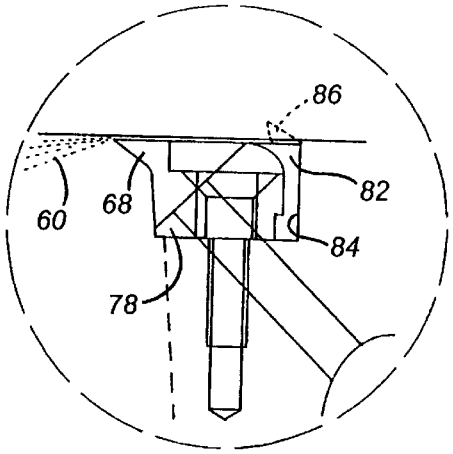
FIG. 7 is an enlarged sectional view of area 7 of FIG. 6.

The inventive apparatus and method by which the drag mold 46 is removed from drag flask 34 is shown in FIG. 6 wherein compressed air 60 is injected into drag flask 34 between drag mold 46 and matchplate 36 upon the completion of the compression step shown in FIG. 3. The injected air causes the drag mold 46 to separate from the matchplate 36 to a degree sufficient to allow gravity to pull drag mold 46 therefrom. The injected air also negates the vacuum which would normally be created by the removal of drag mold 46 from drag flask 34 to thereby result in a more uniformly created drag mold 46 as will be described with further detail herein.

Figure 5:
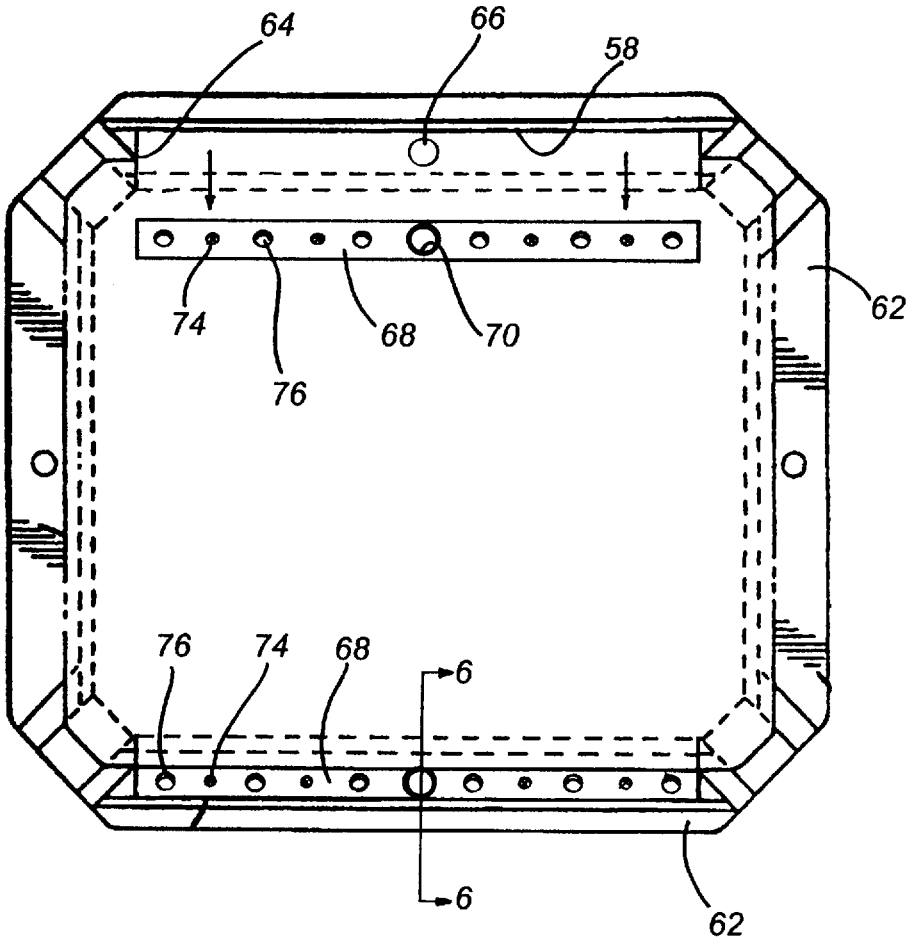
FIG. 5 is a plan view of the drag flask showing one manifold removed.

Referring now to FIGS. 5 and 6, the apparatus by which compressed air 60 is injected into drag flask 34 can be readily appreciated. As is conventional, drag flask 34 includes four side walls 62 with two opposed side walls being slightly longer than the other two opposed side walls. However, in alternative embodiments, it is to be understood that various shapes and relative dimensions can be varied with a given drag flask 34. The two opposed side walls having relatively greater length are both equipped with longitudinal recesses 64 machined into inner surface 58 of drag flask 34 proximate upper end 38. It can also be seen that a centrally disposed aperture 66 is disposed within recess 64 through which compressed air can be communicated. Manifold 68 is disposed within, and substantially fills recess 64 and includes a central inlet 70 for receipt of compressed air from conduit 72. In the preferred embodiment of the present invention, manifold 68 includes a plurality of threaded fasteners 74 along its longitudinal axis to secure the manifold to the drag flask 34, but in alternative embodiments, separate means of attachment can certainly be employed. It can also be seen that manifold 68 includes a plurality of air outlets 76 along its longitudinal axis. Manifold 68, as best shown in FIG. 6, is shaped to define a longitudinal channel 78 which communicates air from aperture 66 to individual air outlets 76.

In operation, it can therefore be seen that when air is injected from compressor 80 through conduit 72 and into recess 64 through aperture 66, a plurality of air jets 60 exit through air outlet 76 to be dispersed between matchplate 36 and drag mold 46. It is these air jets 60 which serve to separate drag mold 46 from matchplate 36 and thereby allow drag mold 46 to separate from drag flask 34 when platen 51 is lowered from drag flask 34.

FIG. 6 also shows that an elastomeric seal 82 is disposed between manifold 68 and rear wall 84 of recess 64. Elastomeric seal 82 includes an upper extending lip 86 which is adapted to fold inward when matchplate 36 is attached to drag flask 34 to thereby prevent the air 60 being injected through air outlet 76 from passing out of drag flask 34, and rather causes the air 60 to be directed inwardly between drag mold 46 and matchplate 36. Elastomeric seal 82 runs the length of manifold 68.

In order to have the present invention operate efficiently, an apparatus needs to be provided to detect when drag mold 46 has been fully compressed to cause air compressor 80 to inject air through conduit 72 to release drag mold 46. Therefore, as shown in FIGS. 2 and 3, in the preferred embodiment of the present invention, a photo-electric cell 88 is provided on frame 90 of mold forming station 22 to detect when drag flask 34 has reached its lowest position. When drag flask 34 has reached its lowest position, conduit 72 mates against conduit seat 92 also attached to frame 90. Conduit seat 92 is then connected to a second conduit 94 for direct communication with compressor 80. Conduit seat 92 includes an elastomeric member to provide sufficient sealing between second conduit 94 and first conduit 72.

Once drag flask 34 has reached its lowest position and triggered photo-electric cell 88, cell 88 will send a signal to processor 96 which in turn will send a signal to compressor 80 to inject air for a predetermined length of time to release drag mold 46. Although a photo-electric cell 88 is employed in the preferred embodiment of the present invention, in alternative embodiments different sensors including proximity switches can be used with equal efficacy. Upon drag mold 46 being released from drag flask 34, a pusher arm (not shown) attached to the drag flask will then be used to direct drag mold 46 onto exit conveyor 98 (see FIG. 1) when the drag flask has been filled for a subsequent mold to be formed. However, cope mold 44 will have first been released from cope flask 32 and placed on top of drag mold 46 to form the completed sand mold 30. Sand mold 30 is then fully formed with internal cavity 56 for receipt of molten metal 100.

It can therefore be seen by those of ordinary skill in the art that the present invention provides a new and improved apparatus and method for releasing drag molds from drag flasks in a predictable and uniform manner even when relatively hard molds are produced. Not only does the present invention provide a more reliable system for removing a drag mold from a drag flask, but does so in an efficient manner without the need for mechanical vibration machines or spring-biased flask liners. Moreover, through the injection of air as the drag mold is released, the vacuum which would normally result within the flask is avoided. This in turn produces a mold having a well defined and crisp shape.

What is claimed is:

1. In a sand mold forming apparatus including a drag flask for forming a drag mold of compressed green sand having an internal cavity corresponding to a portion of a desired casting, and a matchplate attached to the drag flask and having patterns protruding therefrom for forming the internal cavity, an improved mechanism for releasing the drag mold from the drag flask and matchplate, comprising:

a plurality of air inlets within the drag flask and proximate the matchplate, the plurality of air inlets being adapted to communicate compressed air between the drag mold and the matchplate; and means for communicating compressed air from a source of compressed air to the plurality of air inlets to thereby release the drag mold from the drag flask.

2. The sand mold forming apparatus of claim 1 wherein the drag flask includes four sides forming a rectangular enclosure with an open top and bottom, the matchplate is attached to the rectangular enclosure with the patterns protruding through an open top of the enclosure, and the plurality of air inlets are provided in the drag flask sides proximate the open top.

3. The sand mold forming apparatus of claim 2 wherein the plurality of air inlets are provided in at least two opposed sides of the drag flask.

4. The sand mold forming apparatus of claim 3 wherein the two opposed sides include longitudinal recesses therein and the release mechanism further includes manifolds disposed within the recesses to communicate compressed air from a centrally disposed inlet to a plurality of outlets provided along the manifold.

5. The sand mold forming apparatus of claim 4 wherein the manifolds are dimensioned to be slightly below the matchplate to define an air passage therebetween for communicating the compressed air between the matchplate and the drag mold.

6. The sand mold forming apparatus of claim 5 further including an elastomeric seal provided between the manifold and a side of the recess, the elastomeric seal being contoured to direct the compressed air between the matchplate and the drag mold through the air passage.

7. The sand mold forming apparatus of claim 4 wherein the means for communicating compressed air includes a conduit attached to the drag flask having an outlet connected to the manifold inlet and an inlet adapted to mate with the source of compressed air.

8. The sand mold forming apparatus of claim 7 wherein the drag flask is adapted for vertical movement during compression of the green sand mold, and further including a sensor to detect when the drag flask has reached an end of the vertical movement, the sensor adapted to transmit a signal to the source of compressed air to direct compressed air to flow through the conduit to release the sand mold.

9. The sand mold forming apparatus of claim 8 wherein the outlet for the source of compressed air includes an elastomeric seat adapted to receive the conduit inlet when the drag flask has reached an end of the vertical movement.

10. A sand mold forming apparatus, comprising:

a drag flask having four sides defining a rectangular enclosure having an open top and bottom;

a matchplate attached to the drag flask with patterns protruding from the matchplate and into the rectangular enclosure through the open top, the drag flask adapted to be filled with sand to be compressed around the matchplate patterns from a compressive force directed through the open bottom of the drag flask;

a frame over which the drag flask is adapted for vertical movement; and means for injecting pressurized air into the drag flask to release compressed green sand drag mold from the drag flask and matchplate and onto the frame.

11. The sand mold forming apparatus of claim 10 wherein the means for injecting pressurized air includes a plurality of air inlets in the drag flask sides proximate the open top.

12. The sand mold forming apparatus of claim 11 wherein the plurality of air inlets are provided in at least two opposed sides of the drag flask.

13. The sand mold forming apparatus of claim 12 wherein the two opposed sides include longitudinal recesses therein and the forming apparatus further includes manifolds disposed within the recesses to communicate compressed air from a central air inlet provided within the recess to a plurality of outlets provided along the manifold.

14. The sand mold forming apparatus of claim 13 wherein the manifolds are dimensioned to be slightly below the matchplate to define an air passage therebetween.

15. The sand mold forming apparatus of claim 14 further including an elastomeric seal provided between the manifold and a side of the recess, the elastomeric seal being contoured to direct the compressed air entirely between the matchplate and the drag mold.

16. The sand mold forming apparatus of claim 13 further including a conduit attached to the drag flask and adapted to connect the manifold inlet to an outlet of compressed air attached to the frame.

17. The sand mold forming apparatus of claim 16 further including a sensor mounted to the frame and adapted to sense when the conduit has connected to the compressed air outlet attached to the frame.

18. The sand mold forming apparatus of claim 17 wherein the compressed air outlet includes an elastomeric seat adapted to receive the conduit inlet.

19. A method of releasing a drag mold from a drag flask and matchplate attached thereto, comprising the steps of:

providing a plurality of air injection inlets in the drag flask between the drag flask and the matchplate; and injecting compressed air through the air inlets to force compressed air between the drag mold and the matchplate to release the sand mold from the matchplate to allow gravity to pull the sand mold from the drag flask.

20. The method of claim 19 further including the step of lowering the drag flask to a predetermined level to thereby activate a sensor which then directs the compressed air to be injected.

* * * * *